United States Patent [19]

Casciano

[11] 4,217,709

[45] Aug. 19, 1980

[54] SUBMARINE SAND SAMPLER

[75] Inventor: Frederick M. Casciano, Honolulu, Hi.

[73] Assignee: The Research Corporation of the University of Hawaii, Honolulu, Hi.

[21] Appl. No.: 880,746

[22] Filed: Feb. 24, 1978

[51] Int. Cl.[2] ..... E02F 3/88

[52] U.S. Cl. ..... 37/62; 37/72

[58] Field of Search ..... 37/DIG. 8, 62, 61, 63, 37/58, 72

[56] References Cited

U.S. PATENT DOCUMENTS

| | | | |
|---|---|---|---|
| 890,764 | 6/1908 | Geare | 37/58 UX |
| 925,079 | 6/1909 | Carlesimo | 37/58 |
| 1,065,229 | 6/1913 | Estes | 37/63 X |
| 1,425,165 | 8/1922 | Bennett | 37/58 |
| 1,461,240 | 7/1923 | Godfrey | 37/61 |
| 1,861,349 | 5/1932 | Lockett | 37/61 X |
| 2,019,968 | 11/1935 | Holloway | 37/62 |
| 2,125,740 | 8/1938 | Schacht | 37/62 |
| 3,153,290 | 10/1964 | Saito | 37/62 |
| 3,224,121 | 12/1965 | Denning | 37/58 |
| 3,429,062 | 2/1969 | Nelson | 37/DIG. 8 |
| 3,434,551 | 3/1969 | Rosfelder | 175/6 |
| 3,456,371 | 7/1969 | Graham et al. | 37/61 X |
| 3,504,943 | 4/1970 | Steele et al. | 37/DIG. 8 |
| 3,589,040 | 6/1971 | DeKoning et al. | 37/58 |
| 3,763,580 | 10/1973 | Kuntz, Jr. | 37/61 |
| 3,765,727 | 10/1973 | Santangelo et al. | 37/DIG. 8 |
| 3,874,462 | 4/1975 | Harms et al. | 175/5 |
| 4,053,181 | 10/1977 | Saito | 37/58 X |

FOREIGN PATENT DOCUMENTS

| | | | |
|---|---|---|---|
| 234395 | 5/1960 | Australia | 37/63 |
| 561202 | 5/1944 | United Kingdom | 37/63 |

*Primary Examiner*—Clifford D. Crowder

*Attorney, Agent, or Firm*—James Creighton Wray

[57] ABSTRACT

A subsurface sampler which obtains samples of sand from offshore deposits. A 27 foot tube within a tube is lowered to the ocean floor while suspended from flotation tanks. The sampler is free of suspension cables and thus is detached from boat motions. Surface sand is sucked up through the suction tube and pumped to a container on deck by a jet pump.

A jet pump is actuated by high pressure drive water sent down a three inch hose to the top of the sampler, through the void between the two pipes, and to an annular jet nozzle. The nozzle directs the flow upward in the two-inch center pipe through a venturi-shaped throat piece. The throat piece causes sand to be sucked up the suction tube and transported in a slurry through the inner pipe and a two-inch slurry hose to the surface. A manifold valve in the inner pipe shuts off upward flow, jetting water from the lower intake and flowing away sand to let the sampler drop deeper into a deposit.

Upward pointing nozzles on the outer pipe provide an upward flow of water around the periphery of the sampler, preventing sand from collapsing around the sampler embedding it in the sand. A sharpened cutting tip helps break up compacted sand. A mercury switch senses deviation from vertical, and a sonar device measures distance of the tip of the sampler pipe from the sand surface.

26 Claims, 6 Drawing Figures

SUBMARINE SAND SAMPLER

BACKGROUND OF THE INVENTION

1. Field of Invention

The present invention relates generally to excavating devices and more specifically to submarine excavating devices.

2. Description of the Prior Art

Examples of the most pertinent patents found are U.S. Pat. Nos.: 3,153,290; 3,434,551; 3,763,580; 3,874,462.

U.S. Pat. No. 3,434,551 shows a core sampler comprising a bouyant rig for supporting coring operations underwater. The bouyant rig comprises a float and a bottom weighted stand interconnected by a guide wire. A core barrel slidably extends through the weighted stand. A piston slidably mounted in the core barrel penetrates the ocean bottom. Suction is provided by a hydraulic pump mounted on the bottom weighted stand.

U.S. Pat. No. 3,153,290 discloses a submarine sampler comprising a jet pump having a jet pump nozzle, a downward nozzle for shaving and a horizontal nozzle for cutting sediment. A flexible pipe is connected to a floating operation deck which is capable of moving the water pump until it reaches the gravel layer.

U.S. Pat. No. 3,874,462 shows an excavation apparatus comprising a core barrel slidably mounted inside a guide tube for deploying and recovering the core barrel. The guide tube has two openings, an entrance and an exit for the core barrel to move through the guide tube passageway after having taken samples.

U.S. Pat. No. 3,763,580 is directed to an apparatus for dredging in deep ocean comprising an elongated hollow conduit and a dredging tool connected to the conduit pendulously supported from a floating vessel. The conduit is rotated to rotate the dredging tool along the ocean floor. Material loosened by the dredging tool is lifted upward through the hollow conduit by an air lift mechanism in which pressurized air is injected into the conduit to force materials to flow upwardly.

A number of problems remain in the prior art that are addressed by the present invention. With the exception of U.S. Pat. No. 3,153,290, the prior art disclosures require either guide wires or stands of some sort to help deploy the elongated barrel means for excavating ocean material. The present invention does not require any guide wires or stands to maintain its vertical in ocean swells. The plural flotation tanks effectively maintain the vertical of the invention, precluding a need for additional supports. U.S. Pat. No. 3,153,290 requires a floating stand hovering over the area to be excavated as the conduits connected to the pump originate from this floating stand. The present invention does not require a special floating stand. Hoses attached to the conduits allow the surface vessel a range of flexibility in choosing its position. The surface vessel need not hover directly over the area to be excavated. The present invention is equipped with a depth sensing device to relay the depth of penetration to the surface vessel. None of the prior art disclosures reveal such a device. The present invention further comprises an airlift mechanism especially designed to assist the collection of ocean sediment in depths greater than 150 feet. This mechanism injects air into the flow of sediment, thus lowering the specific gravity of the sediment, aiding the upward flow of collected sand and seawater. None of the prior art disclosures reveal such a mechanism.

The present invention consists of an inner pipe within a pipe held rigidly together by screws. This design aids in maintaining the rigidity of the sampler against the force of pressurized water encountered in the ocean. No additional sidewalls are necessary to shield the collection conduit as the outer pipe serves to shield the inner pipe against collapse.

The present invention is relatively inexpensive to manufacture in comparison to prior art excavation devices. The principal components of the invention can be assembled from pipe fittings with only the throat piece of the jet pump requiring machining and casting.

No special rigging apparatus is required by the surface vessel in deploying the invention in the ocean. As a result, any small commercially available vessel may adequately perform excavating operations. The design of prior art devices precludes small vessels from engaging in excavating operations requiring vessels equipped with winches and other specially designed equipment.

SUMMARY OF THE INVENTION

The present invention is an improvement over prior art submarine excavating devices. The present invention comprises dual concentric conduits, one mounted within the other attached to a six foot suction head weighted with approximately 250 pounds of lead. Lubricating jets attached to the outer conduit are spaced at regular intervals and also circumscribe the outer conduit. These jets have upward pointing nozzles which emit a continuous stream of pressurized water. These jets serve to prevent ocean sediment from collapsing around the sampler, thus blocking the passage of the sampler upward to the surface. A three inch hose is attached to a sidewall of the outer conduit and is used to transmit pressurized water from the surface vessel to the void between the two conduits. This void acts as a passageway to convey pressurized water to the lubricating jets and also to convey pressurized water to a jet pump located at the lower end of the inner conduit. The jet pump has an annular jet nozzle which may be described as funnel shaped at the lower end of the inner conduit. The annular jet nozzle directs a flow of water upward through a throat piece which is a venturi shaped steel insert in the inner conduit.

The sampler head is equipped with a sharpened cutting tip for breaking up compacted sand. Lateral openings in the suction nozzle of the sampler head allow ocean sediment to be sucked up into the sampler. A filter screens out particles greater than one-half inch in size from being collected, thereby preventing the throat from becoming clogged. The suction tube of the sampler head is slidably mounted by a compression gasket. This allows the suction tube to vary the gap in the funnel opening of the jet pump. Changes in the size of the annular jet nozzle change the composition of the collected sediment.

As pressurized water is pumped through the void between the conduits, the jet pump directs this water upward through the inner conduit. A vacuum is created in the suction tube causing sand to be sucked into the suction tube and mixed with the water. The resulting slurry is directed upward by the annular nozzle through the inner conduit. A two-inch hose connected to the upper end of the inner conduit transports the slurry upward to the surface vessel. In depths exceeding 150 feet, a special airlift mechanism is attached to the two-inch hose which injects air into the sand/water mixture. This lowers the specific gravity of the mixture and facilitates easier transportation of the slurry to the surface.

A valve manifold located in the inner conduit can be closed causing the pressurized water to reverse itself at the jet pump and be directed downward and out the suction tube. The jet flow emanating from the suction tube washes away sand beneath the sampler. Coupled with the weight of the sampler as sand is washed away, the sampler will descend into the excavation. Regardless of whether the manifold is open or closed the lubricating jets on the outer conduit continue to prevent sand from collapsing around the sampler. Further, the valve is controlled from the surface vessel along with the source of pressurized water, eliminating any need for diver attendance of the sampler.

A mercury switch is attached to the outer conduit to sense any deviation from the vertical due to strong ocean currents or entanglements in rock or coral.

An ultrasonic transducer is attached to the outer conduit to determine the depth of penetration of the sampler into the ocean floor.

The sampler requires neither suspension cables nor any floating stands to maintain a rigid vertical attitude.

Vertical ridigity is maintained by a wide separation between the center of gravity, found in the weighted sampler head, and the center of buoyancy, found in the buoyant structure attached to the top of the sampler.

The buoyant structure comprises plural flotation tanks. A fixed spherical tank is attached by a cable to the top of the outer conduit. A variable oval shaped ballast tank is attached by a cable to the spherical tank. A float is attached to the variable tank to support the weight of the variable tank.

The present invention is relatively easy to manufacture and requires no special equipment to operate. The sampler is controlled from the surface vessel, and as a result requires little maintenance while conducting an excavation.

OBJECTS OF THE INVENTION

Objects of the invention are to provide a submarine excavating apparatus comprising an intake nozzle configured for penetrating an ocean floor and having a slurry intake opening for receiving a slurry of excavating material and seawater and having an opening upward end, a jet pump connected to the open upward end of the intake nozzle for entraining slurry from the nozzle, a first conduit having an upper end and having a lower end communicating with the jet pump for receiving slurry from the jet pump, a second conduit connected to the jet pump for supplying fluid to the jet pump whereby fluid entrains the excavated material-seawater slurry and drives the slurry through the first conduit, means for connecting a source of pressurized fluid to the second conduit and means for connecting collecting means to the first conduit.

Another object of the invention is to provide conduits which are concentric pipes.

Another object of the invention is to provide the second conduit which surrounds the first conduit.

Another object of the invention is to provide a plurality of lubricating jets circumscribing the second conduit and spaced in a series along the length of the second conduit at regular intervals.

Another object of the invention is to provide lubricating jets comprising upward pointing nozzles for preventing ocean material from clogging the path of the second conduit.

Another object of the invention is to provide a jet pump further comprising a constricted funnel opening at the lower end of the first conduit for receiving the open upward end of the intake nozzle.

Another object of the invention is to provide a jet pump further comprising in a lower end of the first conduit a venturi opening.

Another object of the invention is to provide a compression gasket mounted on a lower end of the second conduit for receiving and holding the intake nozzle and allowing the intake nozzle to be slidably adjustable within the gasket and funnel opening of the jet pump.

Another object of the invention is to provide an open upper end of the intake nozzle tapered to fit the funnel opening of the jet pump.

Another object of the invention is to provide a series of cutting jets circumscribing the conduits for removing ocean material.

A further object of the invention is to provide an intake nozzle having a series of lateral openings for receiving a slurry of excavated material and seawater.

A further object of the invention is to provide an intake nozzle having a restricted bottom opening with a sharpened cutting tip for breaking up compacted ocean material.

A further object of the invention is to provide an intake nozzle having a filter to prevent clogging of the funnel shaped opening of the first conduit.

A further object of the invention is to provide a tilt sensing means comprising an omnidirectional mercury switch for sensing vertical condition of the conduits.

A further object of the invention is to provide depth limiting means comprising a horizontal extension connected to an upper end for preventing the conduits from further penetrating an ocean floor.

A further object of the invention is to provide depth penetration sensing means comprising an ultrasonic transducer for measuring the degree of penetration of the conduits into the ocean floor.

A further object of the invention is to provide a lifting bail for raising and lowering the conduits.

A further object of the invention is to provide a valve means for controlling the flow of slurry driven through a conduit by the jet pump.

Still a further object of the invention is to provide a buoyant structure connected to the lifting bail for maintaining vertical alignment of the conduits.

Still a further object of the invention is to provide collecting means comprising tubes connected to the conduits and leading to a source of pressurized fluid on the surface.

Still a further object of the invention is to provide airlift means comprising a cylindrical collar with openings for releasing air into the collecting means and means connected to the collar for supplying compressed air to the collar for lifting the slurry through the collecting means up to the ocean surface.

DETAILED DESCRIPTION OF THE DRAWINGS

Figure 1:
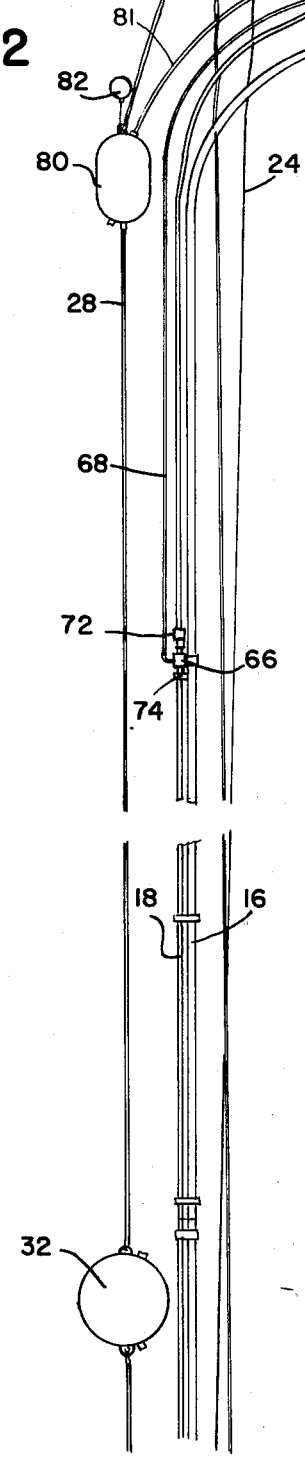
FIG. 1 shows a perspective of the lower half of the sampler.
Figure 1:
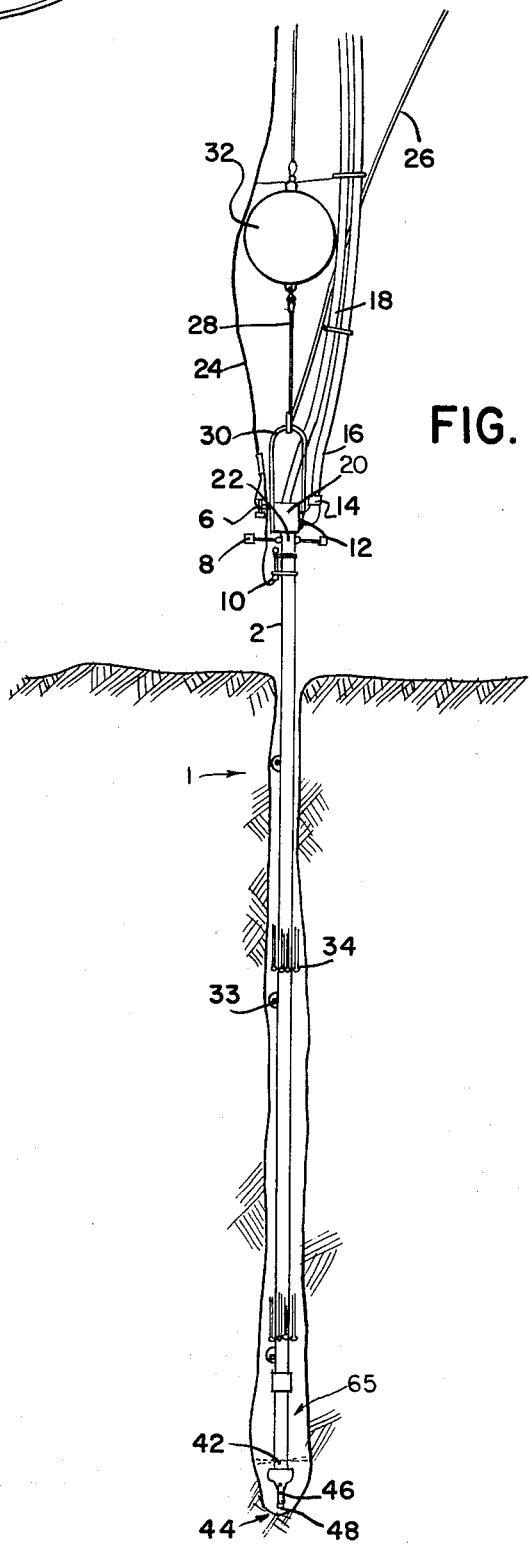

Referring to FIG. 1 submaring sampler apparatus 1 comprises conduit 2 attached to sampler head by coupling 45. Lubricating jets 34 are found along the length of the conduit spaced at five foot intervals. Lubricating jets 34 circumscribe conduit 2. Lubricating jets 34 comprise upward pointing nozzles described in detail in FIG. 4. Lifting padeyes 33 are attached to the sidewall of outer conduit 2. Cables can be attached to lifting padeyes 33 to aid in extracting sampler 1 from the excavation. Sampler head 65 comprises cutting jets 42 which circumscribes outer conduit 2. Cutting jets 42 comprise one sixteenth diameter holes which allow pressurized fluid to emanate from outer conduit 2. This fluid assists in excavating ocean sediment allowing sampler 1 to penetrate the ocean floor. Sampler head 65 has lateral openings 46 which entrains sand into said suction nozzle 44. Suction nozzle 44 has sharpened cutting tip 48 for loosening compacted ocean sediment.

A tilt sensing switch 10 is mounted at the top of outer conduit 2. Tilt sensing switch 10 detects any deviation from the vertical of the sampler 1 and transmits a signal to the surface vessel. An electric cable 24 is connected to tilt sensing switch 10. Located above tilt sensing switch 10 is depth limiting means 8 consisting of horizontal extensions mounted on the sidewall of outer conduit 2. These extensions 8 prevent further penetration of the sampler 1.

A three-inch diameter hose 16 is connected by a pipe coupling 14 in the sidewall opening 12 of outer conduit 2. Pressurized fluid passes through hose 16 on the surface vessel. A lifting bail 30 is attached to the top of outer conduit 2 for connecting a tether 26 which pulls the sampler up to the surface vessel. Connected to the lifting bail is ultrasonic transducer 6. Sound waves are bounced off the ocean floor and transmitted to a readout on the surface vessel. The readout shows the length of the sampler 1 still above the ocean floor and therefore, by subtraction the depth of penetration. Electric cable 24 is connected to transducer 6. Extending above the top of outer conduit 2 is the top of inner conduit 4 and pipe coupling 20. Manifold valve means 22 can be closed reversing the upward flow of pressurized fluid back down the length of inner conduit 4 and out suction nozzle 44. Slurry hose 18 is connected to pipe coupling 20. Slurry hose 18 transports to the surface vessel the sand-seawater mixture gathered by the sampler 1.

Fixed ballast tank 32 is connected to lifting bail 30 by cable 28. The fixed ballast tank 32 is part of a buoyant structure designed to maintain the vertical position of the sampler 1. Fixed ballast tank 32 is spherical.

Figure 2:
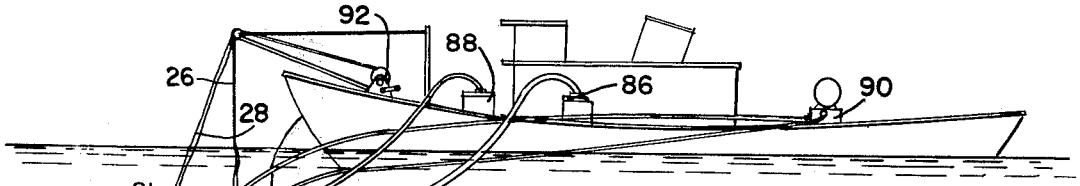
FIG. 2 shows a perspective view of the upper half of the sampler leading to the surface vessel.

Referring now to FIG. 2, an air lift mechanism comprises collar 66, female kamlock 72, and male kamlock 74. Air is injected through collar 66 through holes 70 shown in FIG. 6. The introduction of air into the sand-seawater mixture lowers the specific gravity of the mixture and aids in transporting the mixture upward through hose 18 to the surface. Air reaches the collar 66 through air hose 68 connected to air compressor 90 on the surface vessel.

Another air hose 81 is attached to oval shaped ballast tank 80. The air pressure of ballast tank 80 is varied to accomodate different ocean conditions. Air hose 81 is also connected to air compressor 90 on the surface vessel. Connected to variable ballast tank 80 by a short cable 28 is a float 82. Float 82 supports the weight of variable ballast tank 80. Buoyant structure consisting of spherical ballast tank 32, variable tank 80, and float sized support 82 maintain the vertical of sampler 1.

Referring now to the surface vessel of FIG. 2, slurry hose 18 is connected to slurry collection means 88. Hose 16 is connected to water pump 86. Water pump 86 supplies the pressurized fluid which is mixed with excavated sand and pumped up through slurry hose 18.

Tether 26 connected to the lifting bail 30 of outer conduit 2 is connected to a crank 92 on board the surface vessel. Crank 92 facilitates the extracting of the sampler 1 from the ocean floor although such a crank is not absolutely necessary.

Figures 3, 6:
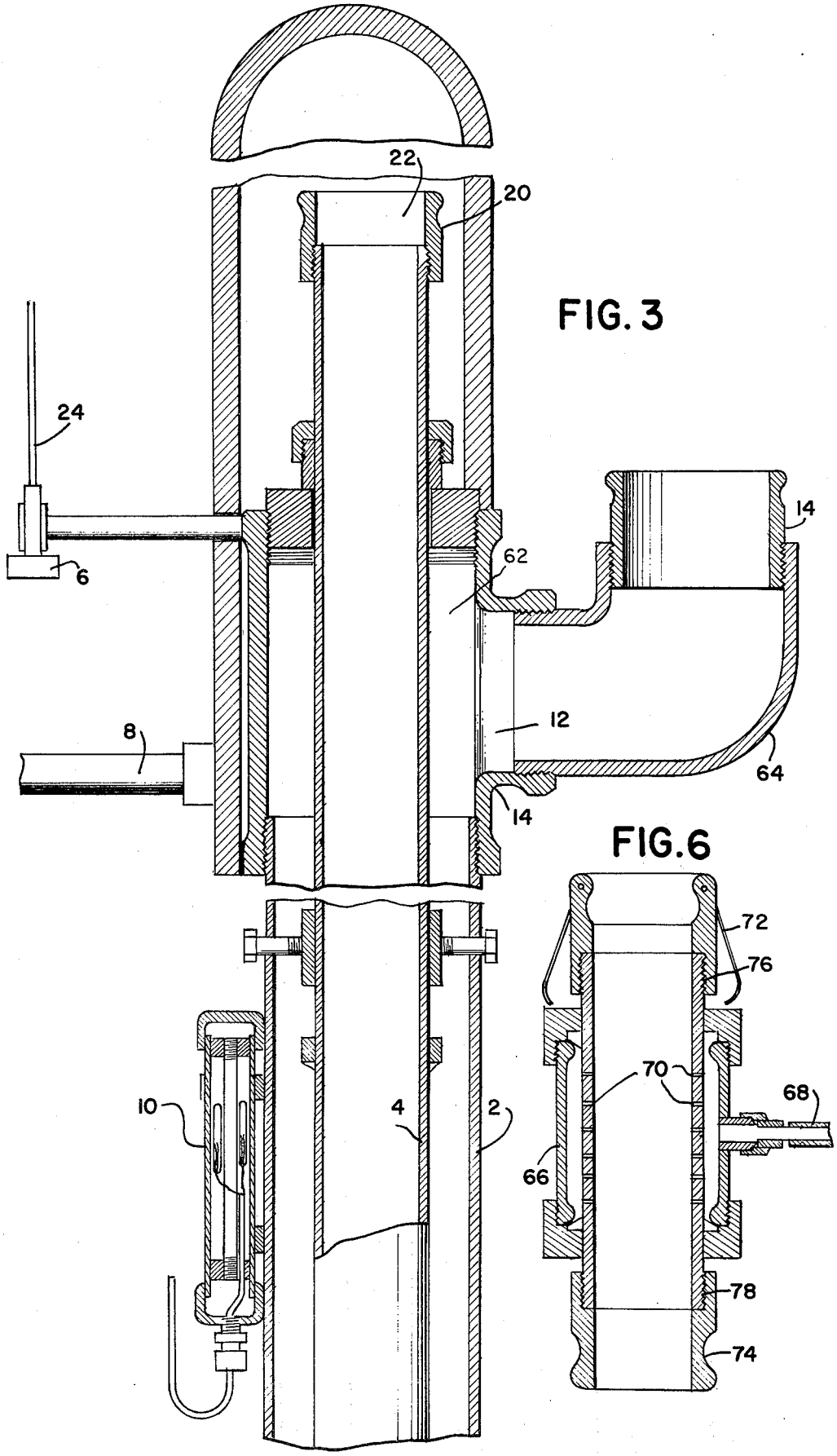
FIG. 3 shows a cross-section of the upper end of the sampler. section of the sampler.
FIG. 6 shows an enlarged cross-section of the airlift mechanism.

FIG. 3 is an enlarged view of the upper end of the sampler 1. Inner conduit 4 is rigidly mounted inside outer conduit 2 by screws penetrating outer conduit 2 and held by support sleeves on inner conduit 4. Lifting bail 30 is welded along the sidewall of outer conduit 2. Ultrasonic transducer 6 is welded at the top of outer conduit 2. Connected to transducer 6 is electric cable 24 which leads to the surface vessel. Depth limiting means 8 consisting of horizontal extensions is connected to a pipe coupling and welded to outer conduit 2. Tilt sensing means 10 comprising omnidirectional mercury switches is mounted along a sidewall of outer conduit 2. Electric cable 24 is also connected to tilt sensing means 10.

A curved coupling 64 is connected to outer conduit 2 at opening 12 in the sidewall of outer conduit 2. Pipe coupling 14 is connected to curved pipe coupling 64 to receive hose 16 (not shown). Pressurized water from hose 16 enters pipe couplings 14 and 64 respectively and enters void 62 between the inner conduit 4 and outer conduit 2 at opening 12 of outer conduit 2.

Figure 4:
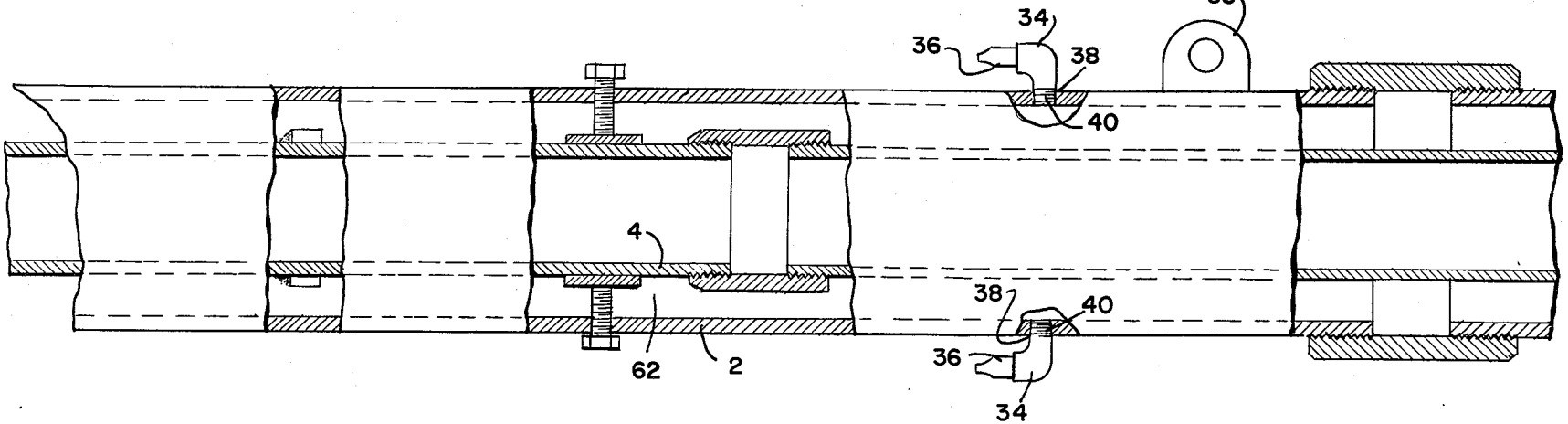

FIG. 4 is an enlarged sectional view of outer conduit 2 and inner conduit 4. Lubricating jets 34 circumscribe outer conduit 2. Lubricating jets 34 comprise upward pointing nozzles 36 and pipe threads 40. Lubricating jets 34 are screwed into slots 38 via threads 40. These jets 34 omit a continuous stream of pressurized water from void 62 which prevents ocean sediment from collapsing around the sampler head, burying sampler 1, and preventing the extraction of sampler 1 from the ocean floor. Lifting padeyes 33 are found along the sidewall of outer conduit 2. A cable may be attached to these padeyes 33 to aid in lifting the sampler 1 from the excavation.

Figure 5:
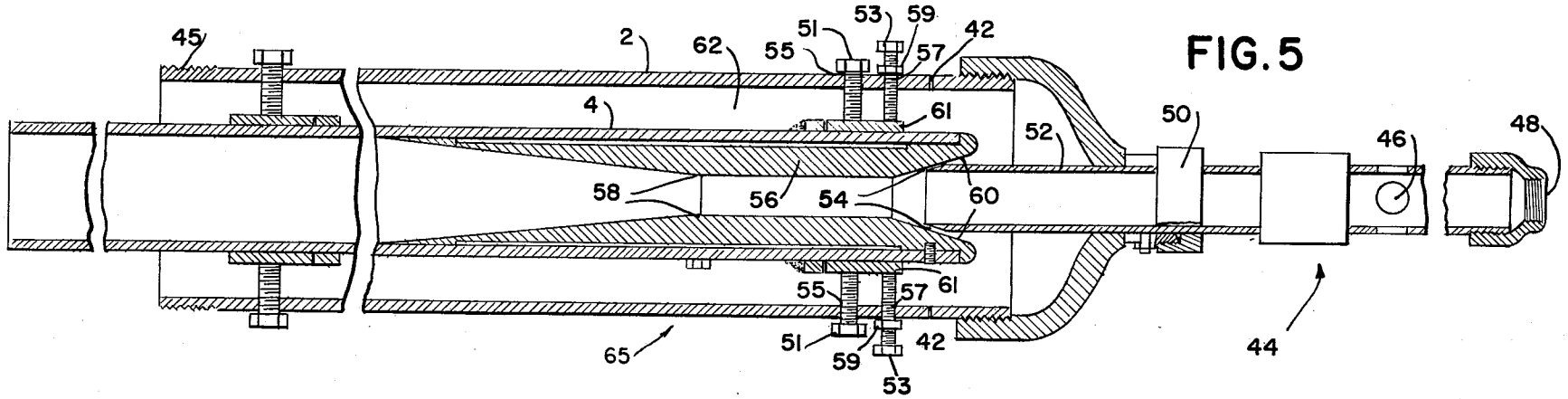
FIG. 5 shows a cross-section of the sampler head suction tube and jet pump apparatus.

Referring to FIG. 5 sampler head 65 comprises suction nozzle 44, outer conduit 2, and inner conduit 4.

Suction nozzle 44 comprises lateral openings 46, and sharpened cutting tip 48. Lateral openings 46 allow sand to be collected by the sampler. Sharpened cutting tip 48 breaks up compacted sand in excavating operations.

Suction nozzle 44 is slidably mounted in sampler head 65 by a compression gasket 50 found on the sidewalls of outer conduit 2. Suction nozzle 44 has an upper tapered end 54 which slides in and out of funnel opening 60 of inner conduit 4. Upper section 52 of suction nozzle 44 fits in the cavity between outer conduit 2 and inner conduit 4.

Jet pump 56 comprises funnel opening 60, tapered end 54 of suction nozzle 44, and venturi shaped insert 58 which is the lower opening of inner conduit 4. Jet pump 56 directs the flow of pressurized water from void 62 between outer conduit 2 and inner conduit 4 upward through funnel opening 60. A vacuum created by the flow of water in suction nozzle 44 entrains ocean sand and pushes sand through suction nozzle 44 into inner conduit 4. Jet pump 56 continues pushing the mixture of sand and water through the venturi shaped insert 58 through inner conduit 4.

Inner conduit 4 is rigidly mounted inside outer conduit 2 by screws 51 and 53 and is held by support sleeves 61 on the sidewalls of inner conduit 4. Screws 51 are mounted through thread holes 55 found on the sidewall of outer conduit 2. Screws 53 mount through thread holes 57 on outer conduit 2. Added support is provided by lock nut 59 which locks screws 53 into place along outer conduit 2.

Cutting jets 42 circumbscribe the lower end of outer conduit 2. Cutting jets emit a continuous stream of pressurized water against ocean sediment loosening sediment for easier penetration of the suction nozzle into the ocean floor.

Referring now to FIG. 6, a series of air holes 70 found in collar 66 of an air lift mechanism allow air from hose 68 to be injected into the upward flow of sand and seawater. Injected air lowers the specific gravity of the mixture facilitating the upward flow of slurry to the surface vessel. Collar 66 is held to slurry hose 18 by female and male kamlocks 72 and 74 respectively. Kamlocks 72 and 74 are connected by screw threads 76 and 78 to fit collar 66 to different size hoses.

While the invention has been described with reference to a specific embodiment, the exact nature and scope of the invention is defined in the following claims.

What is claimed is:

1. A submarine excavating apparatus comprising
an intake nozzle configured for penetrating an ocean floor and having a slurry intake port for receiving a slurry of excavated material and seawater and having an open upward end
a jet pump connected to the open upward end of the intake nozzle for entraining slurry from the nozzle
a first conduit having an upper end and having a lower end communicating with the jet pump for receiving slurry from the jet pump
a second conduit concentrically surrounding the first conduit connected to the jet pump for supplying fluid to the jet pump whereby fluid entrains the excavated material-seawater slurry and drives the slurry through the first conduit
means for connecting a source of pressurized fluid to the second conduit
means for connecting collecting means to the first conduit and a plurality of lubricating jets circumscribing the second conduit and spaced in a series along the length of said second conduit, some of said jets having upwardly pointing nozzles for preventing ocean material from clogging the path of said second conduit,
depth penetration means connected to an upper end of the conduits for measuring the degree of penetration of the conduits into the ocean floor.

2. The apparatus of claim 1 wherein
the jet pump further comprises a constricted funnel opening at the lower end of the first conduit for receiving the open upward end of the intake nozzle.

3. The apparatus of claim 2 wherein
the jet pump further comprises in a lower end of the first conduit a venturi opening.

4. The apparatus of claim 2 further comprising
a compression gasket mounted on a lower end of the second conduit for receiving and holding the intake nozzle and allowing the intake nozzle to be slidably adjustable within the gasket and funnel opening of the jet pump.

5. The apparatus of claim 2 wherein
the open upper end of the intake nozzle is tapered to fit the funnel opening of the jet pump.

6. The apparatus of claim 1 further comprising
a series of cutting jets circumscribing the conduits for removing ocean material.

7. The apparatus of claim 1 wherein
the intake nozzle is spaced slightly from the lower end of the first conduit and is slidably adjustable with respect to the lower end of the first conduit.

8. The apparatus of claim 7 wherein
the intake nozzle has a restricted bottom opening with a sharpened cutting tip for breaking up compacted ocean material.

9. The apparatus of claim 1 wherein
the intake nozzle has a series of lateral openings for receiving a slurry of excavated material and seawater.

10. The apparatus of claim 1 further comprising
a tilt sensing means connected to one of the conduits.

11. The apparatus of claim 10 wherein
the tilt sensing means comprises an omnidirectional mercury switch for sensing vertical condition of the conduits.

12. The apparatus of claim 1 further comprising
a depth limiting means connected to one of the conduits.

13. The apparatus of claim 12 wherein
the depth limiting means comprises a horizontal pipe connected to an upper end for preventing the conduits from further penetrating an ocean floor.

14. The apparatus of claim 1 further comprising
a depth penetration sensing means connected to an upper end of the conduits and directed downward for sensing distance from the upper end to the ocean floor.

15. The apparatus of claim 14 wherein
the depth penetration sensing means comprises an ultrasonic transducer for measuring the degree of penetration of the conduits into the ocean floor.

16. The apparatus of claim 1 further comprising
a lifting bail connected to an upper end of one of the conduits for raising and lowering the conduits.

17. The apparatus of claim 16 further comprising
a buoyant structure connected to the lifting bail for maintaining vertical alignment of the conduits.

18. The apparatus of claim 17 wherein
the buoyant structure comprises a spherical fixed ballast tank connected to the lifting bail of the conduits.

19. The apparatus of claim 17 wherein
the buoyant structure comprises a variable ballast tank connected to the fixed ballast tank.

20. The apparatus of claim 19 wherein
a float connected to the variable ballast tank supports the weight of the variable ballast tank.

21. The apparatus of claim 17 further comprising
a tether connected to the lifting bail.

22. The apparatus of claim 1 further comprising a valve means connected to the upper open end of the first conduit for controlling the flow of slurry driven through the first conduit by the jet pump.

23. The apparatus of claim 1 further comprising airlift means connected to the collecting means connected to the conduits leading to a source of pressurized fluid on the surface.

24. The apparatus of claim 23 wherein the collecting means comprise tubes connected to the conduits and leading to a source of pressurized fluid on the surface.

25. The apparatus of claim 24 wherein a series of holes spaced at regular intervals in the collar allow air to be mixed with the slurry.

26. The apparatus of claim 23 wherein the airlift means comprises a cylindrical collar with openings for releasing air into the collecting means and means connected to the collar for supplying compressed air to the collar for lifting the slurry through the collecting means up to the ocean surface.

* * * * *